US008419919B1

(12) United States Patent
Boss et al.

(10) Patent No.: US 8,419,919 B1
(45) Date of Patent: Apr. 16, 2013

(54) SYSTEM AND METHOD FOR GENERATING PARTICLES

(75) Inventors: Pamela A. Boss, San Diego, CA (US); Frank E. Gordon, San Diego, CA (US); Stanislaw Szpak, Poway, CA (US); Lawrence Parker Galloway Forsley, San Diego, CA (US)

(73) Assignees: JWK International Corporation, Annandale, VA (US); The United States of America as represented by the Secretary of the Navy, Washington, DC (US)

( * ) Notice: Subject to any disclaimer, the term of this patent is extended or adjusted under 35 U.S.C. 154(b) by 1036 days.

(21) Appl. No.: 11/859,499

(22) Filed: Sep. 21, 2007

Related U.S. Application Data

(60) Provisional application No. 60/919,190, filed on Mar. 14, 2007.

(51) Int. Cl.
*C25D 5/48* (2006.01)
*C25C 1/20* (2006.01)

(52) U.S. Cl.
USPC ..... 205/220; 205/102; 205/265; 205/627

(58) Field of Classification Search ..... 204/229.4, 204/660, 663; 205/339, 340, 565, 627, 102, 205/220, 265, 441
See application file for complete search history.

(56) References Cited

U.S. PATENT DOCUMENTS 6,248,221 B1 6/2001 Davis et al.
6,379,512 B1 * 4/2002 Brown et al. ..... 204/245
6,444,337 B1 9/2002 Iyer
6,562,243 B2 * 5/2003 Sherman ..... 205/745
2001/0019594 A1 9/2001 Swartz
2002/0009173 A1 1/2002 Swartz
2002/0018538 A1 2/2002 Swartz
2002/0021777 A1 2/2002 Swartz
2003/0112916 A1 6/2003 Keeney et al.
2003/0213696 A1 11/2003 Dardik
2005/0045482 A1 3/2005 Storms
2005/0129160 A1 6/2005 Indech
(Continued)

OTHER PUBLICATIONS

J. O'M. Bockris, R. Sundaresan, Z. Minevski, D. Letts. "Triggering of heat and sub-surface changes in Pd-D Systems." The Fourth International Conference on Cold Fusion. Transacations of Fusion Technology, Dec. 1994. vol. 25, No. 4T. p. 267.*

(Continued)

*Primary Examiner* — Keith Hendricks
*Assistant Examiner* — Steven A. Friday
(74) *Attorney, Agent, or Firm* — Ryan J. Friedl; Kyle Eppele

(57) ABSTRACT

A method may include the steps of supplying current to the electrodes of an electrochemical cell according to a first charging profile, wherein the electrochemical cell has an anode, cathode, and electrolytic solution; maintaining a generally constant current between the electrodes; exposing the cell to an external field either during or after the termination of the deposition of deuterium absorbing metal on the cathode; and supplying current to the electrodes according to a second charging profile during the exposure of the cell to the external field. The electrolytic solution may include a metallic salt including palladium, and a supporting electrolyte, each dissolved in heavy water. The cathode may comprise a second metal that does not substantially absorb deuterium, such as gold. The external field may be a magnetic field.

7 Claims, 10 Drawing Sheets

U.S. PATENT DOCUMENTS

| | | | |
|---|---|---|---|
| 2005/0236376 | A1 | 10/2005 | Eccles |
| 2005/0276366 | A1 | 12/2005 | Dash |
| 2006/0088138 | A1 | 4/2006 | Jouanneau |
| 2006/0153752 | A1 | 7/2006 | Arata |
| 2007/0095823 | A1 | 5/2007 | Sedlmayr |
| 2007/0140400 | A1 | 6/2007 | Hodgson |
| 2007/0206715 | A1 | 9/2007 | Godes |
| 2007/0269688 | A1 | 11/2007 | McKubre et al. |
| 2007/0280398 | A1 | 12/2007 | Dardik |
| 2007/0286324 | A1 | 12/2007 | Hagelstein |

OTHER PUBLICATIONS

F. Celani, A. Spallone, P. Tripodi, A. Petrocchi, D. Di Gioacchino, M. Boutet, P. Marini, V. Di Stefano, M. Diociaiuti, W.Collis. "Reproducible D/Pd ratio >1 and excess heat correlation by 1-μS pulse, high-current electrolysis." Fusion Technology, May 1996, vol. 29. pp. 398-404.*

J.O'M. Bockris, R. Sundaresan, D. Letts, Z. Minevski. "Triggering of heat and sub-surface changes in Pd-D systems." Proceeding: Fourth International Conference on Cold Fusion. vol. 2: Calrimetry & Materials Papers. Jul. 30, 1994. pp. 1-1 to 1-46.*

P. Hagelstein. "Summary of the thrid annual conference on cold fusion." Feb. 16, 1993. pp. 1-40.*

D. Cravens. "Factors affecting the success rate of heat generation in CF cells." Fourth International Conference on Cold Fusion. 1993 (no month). pp. 1-14.*

US Department of Energy. "Report of the review of low energy nuclear reactions." Published Dec. 1, 2004. <http://lenr-canr.org/acrobat/DOEreportofth.pdf>.*

R. Van Noorden. "Cold fusion back on the menu." Royal Society of Chemistry (RSC). Published Mar. 22, 2007. <http://www.rsc.org/chemistryworld/News/2007/March/22030701.asp>.*

E. Berger. "Scientist may have cold fusion breakthrough." Houston Chronicle. Published Mar. 23, 2009. <http://www.chron.com/news/nation-world/article/Scientist-may-have-cold-fusion-breakthrough-1728360.php>.*

C. Barras. "Neutron tracks revive hopes for cold fusion." NewScientist. Published Mar. 23, 2009. <http://www.newscientist.com/article/dn16820-neutron-tracks-revive-hopes-for-cold-fusion.html>.*

Szpak, S., Mosier-Boss, P.A., Smith, J.J., "On the Behavior of the Cathodically Polarized Pd/D System: Search for Emanating Radiation", Physics Letters A, Jan. 22, 1996, pp. 382-390, vol. 210, Elsevier Science B.V.

Szpak, S., Mosier-Boss, P.A., "Nuclear and Thermal Events Associated With Pd + D Codeposition", J. New Energy, 1996, p. 54, vol. 1, No. 3.

Szpak, S., Mosier-Boss, P.A., Boss, R.D., Smith, J.J., "On the Behavior of the PD/D System: Evidence for Tritium Production", Fusion Technol., 1998, p. 38, vol. 33.

Szpak, S., Mosier-Boss, P.A., Gordon, F.E., "Precursors and the Fusion Reactions in Polarized Pd/D-D20 System: Effect of an External Electric Field", 11th Int. Conf. on Condensed Matter Nuclear Science, 2004, Marsailles, France.

Szpak, S., Mosier-Boss, P.A., Young, C., Gordon, F.E., "The Effect of an External Electric Field on Surface Morphology of Co-Deposited Pd/D films", J. of Electroanalytical Chemistry, May 23, 2005, pp. 284-290, vol. 580.

Szpak, S., Mosier-Boss, P.A., Young, C., Gordon, F.E., "Evidence of Nuclear Reactions in the Pd Lattice", Naturwissenschaften, Jul. 29, 2005, pp. 394-397, Springer-Verlag.

Szpak, S., Mosier-Boss, P.A., J. Dea, Gordon, F.E, "Polarized D/Pd-D20 System: Hot Spots and Mini-Explosions", 10th Int. Conf. on Cold Fusion, Cambridge, MA, 2003.

Szpak, S., Mosier-Boss, P.A., Miles, M.H., Fleischmann, M., "Thermal Behavior of Polarized Pd/D Electrodes Prepared by Co-Deposition", Thermochimica Acta, 2004, pp. 101-107, vol. 410, Elsevier B.V.

Mosier-Boss, P.A. et al., "Use of CR-39 in Pd/D Co-Deposition Experiments", The European Physical Journal—Applied Physics, Dec. 13, 2007, pp. 293-303, v. 40, EDP Sciences.

Szpak, S., P.A. Mosier-Boss, and J.J. Smith, "Reliable procedure for the initiation of the Fleischmann-Pons effect", Conference Proceedings—Italian Physical Society, 1991. v. 33, pp. 87-91.

Szpak, S. and P.A. Mosier-Boss, and F.E. Gordon, "Precursors and the fusion reactions in polarized Pd/D-D2O system: effect of an external electric field", Condensed Matter Nuclear Science, Proceedings of the International Conference on Cold Fusion, 11th, Marseilles, France, Oct. 31-Nov. 5, 2004, 2006: pp. 359-373.

Szpak, S. and P.A. Mosier-Boss, and F.E. Gordon, "Further evidence of nuclear reactions in the Pd/D lattice: Emission of charged particles", Naturwissenschaften, 2007, v. 94, No. 6, pp. 511-514.

Szpak, S. and P.A. Mosier-Boss, "On the behavior of the cathodically polarized Pd/D system: a response to Vigier's comments", Physics Letters A, 1996, v.221, pp. 141-143.

G.W. Phillips, et al., Neutron Spectrometry Using CR-39 Track Etch Detectors, Radiation Protection Dosimetry, vol. 120, No. 1-4, pp. 457-460, 2006.

Szpak, S., et al., "Absorption of deuterium in palladium rods: model vs. experiment", Journal of Electroanalytical Chemistry, 1994. v.365, No. 1-2, pp. 275-281.

Szpak, S., P.A. Mosier-Boss, and J.J. Smith, "Comments on methodology of excess tritium determination", Frontiers Science Series, 1993, v.4, pp. 515-518.

Szpak, S., et al., Charging of the palladium/hydrogen or deuterium (Pd/nH) system: role of the interphase, Journal of Electroanalytical Chemistry, 1992, v.337(1-2), pp. 147-163.

Szpak, S., P.A. Mosier-Boss, and J.J. Smith, "On the behavior of palladium deposited in the presence of evolving deuterium", Journal of Electroanalytical Chemistry and Interfacial Electrochemistry, 1991, v.302(1-2), pp. 255-260.

F. H. Seguin, et al., "Spectrometry of charged particles from inertial-confinement-fusion Plasmas", Review of Scientific Instruments, vol. 74, No. 2, 2003.

G.W. Phillips, et al., "Neutron Spectrometry Using CR-39 Track Etch Detectors", 4th International Solid State Dosimetry Conference, New Haven, CT, Jun. 28, 2004.

* cited by examiner

1000

1100

1200

1300

1400

1500

1600

SYSTEM AND METHOD FOR GENERATING PARTICLES

CROSS-REFERENCE TO RELATED APPLICATIONS

This application claims the benefit of U.S. Provisional Patent Application Ser. No. 60/919,190, filed Mar. 14, 2007, entitled "Method and Apparatus for Generating Particles," the content of which is fully incorporated by reference herein.

BACKGROUND OF THE INVENTION

The embodiments of the invention relate generally to the field of electrochemistry.

Generated particles may be captured by other nuclei to create new elements, to remediate nuclear waste, to treat cancerous tumors, or to create strategic materials. Previous efforts to create a reproducible method and corresponding system to generate particles during electrolysis of palladium in heavy water have been unsuccessful.

Therefore, a need currently exists for a reproducible method and corresponding system that can generate particles.

DETAILED DESCRIPTION OF SOME EMBODIMENTS

Figure 1:
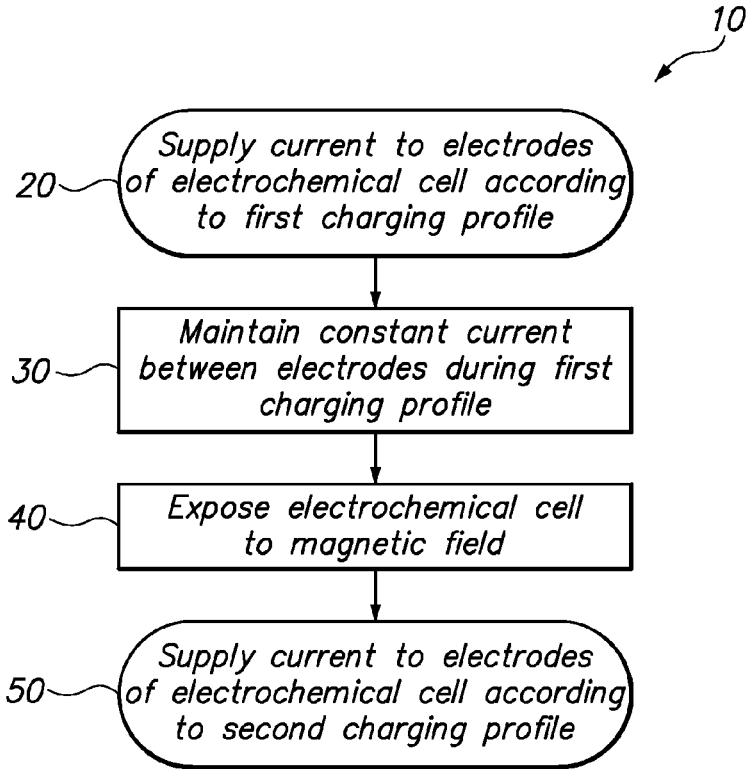
FIG. 1 illustrates a flow chart of an implementation of a method for generating particles.
Figure 4:
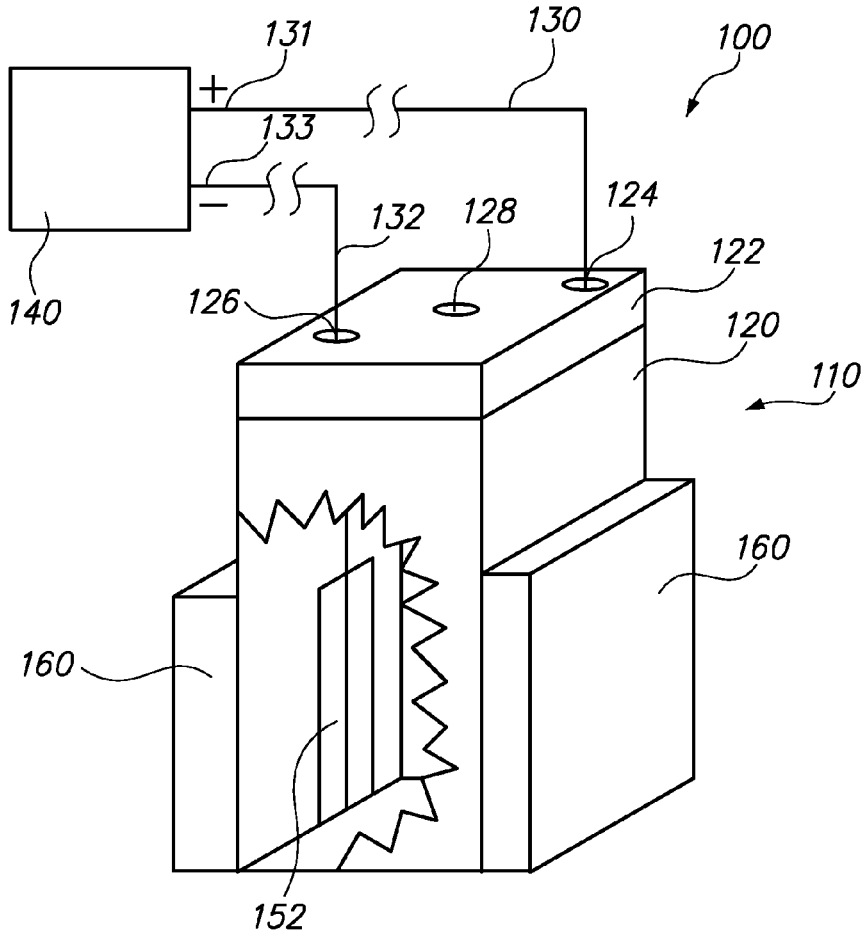
FIG. 4 illustrates a front perspective view of an embodiment of a system for generating particles using an external magnetic field.
Figure 5:
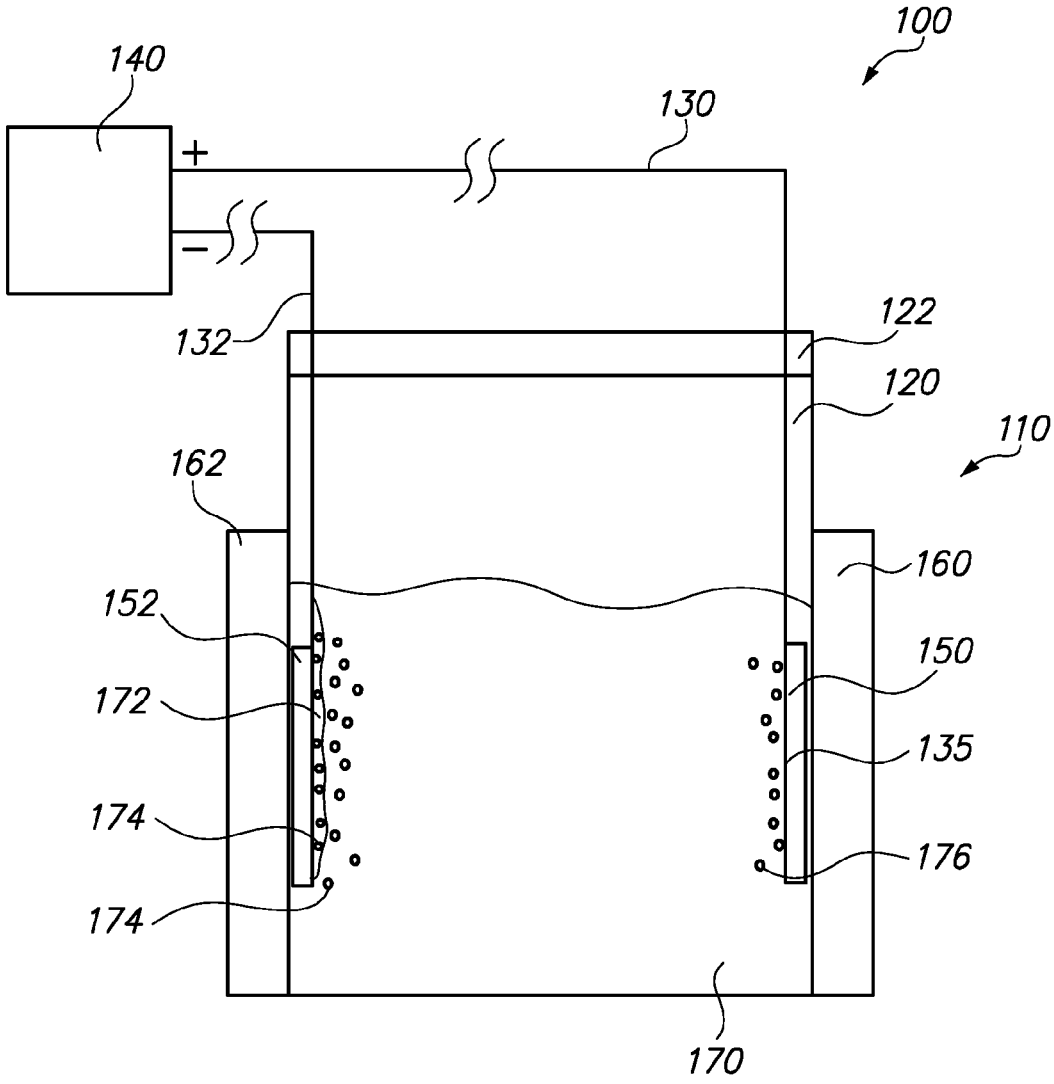
FIG. 5 illustrates a cross-section view of an embodiment of a system for generating particles using an external magnetic field, during a co-deposition process.

FIG. 1 shows a flow chart of an implementation of a method for generating particles 10. One implementation of method 10 may utilize an electrochemical cell 100 as shown in FIGS. 4 and 5. As such, method 10 will be discussed with reference to electrochemical cell 100. Method 10 may be performed at conditions of ambient temperature and standard atmospheric pressure. Method 10 may begin at step 20, where a current may be supplied to the electrodes of an electrochemical cell according to a first charging profile. For example, step 20 may involve supplying current to the positive electrode, anode 130, and the negative electrode, cathode 132, of electrochemical cell 100. Current may be supplied to anode 130 and cathode 132 by connecting a galvanostat/potentiostat 140 to anode 130 and cathode 132. Step 20 is discussed in further detail with regard to FIG. 2. Following step 20, method 10 may proceed to step 30. Step 30 may involve maintaining a generally constant current between the positive and negative electrodes during the first charging profile such that deposition of metal 172 on the cathode occurs in the presence of evolving deuterium gas during electrolysis of an electrolytic solution. As an example, step 30 may involve maintaining a generally constant current between the anode 130 and cathode 132 during the first charging profile. Maintaining a generally constant current serves to ensure that deposition of metal 172 that substantially absorbs deuterium on cathode 132 occurs in the presence of evolving deuterium gas 174 during electrolysis of electrolytic solution 170 (see FIG. 5). A generally constant current may be defined as current that is stable, but that may have minor fluctuations. Step 30 may be performed by connecting a galvanostat/potentiostat 140 to anode 130 and cathode 132.

Method 10 may next proceed to step 40, where electrochemical cell 100 may be exposed to an external field, such as a magnetic field. For example, step 40 may be performed by positioning magnets 160 and 162 opposite one another on opposing sides of electrochemical cell 100 (see FIGS. 4 and 5). Step 40 may occur during the deposition of the metal on the cathode. In other embodiments, step 40 may occur after the termination of the deposition of the metal on the cathode. The determination that the deposition of the metal on the cathode has terminated may be made by a visual inspection that the plating solution within electrolytic solution 170 has turned from a red-brown color to clear. The plating solution turns clear when metal has all been plated onto cathode 132. Method 10 may then proceed to step 50, where a current may be supplied to the electrodes according to a second charging profile during the exposure of the electrochemical cell to the external field. For example, step 50 may involve using a power source to supply a current to anode 130 and cathode 132 according to a second charging profile during the exposure of electrochemical cell 100 to an external magnetic field (not shown).

Particles are generated from the application of method 10. As used herein, the term "generated" is used to refer to the forming of particles through a process involving chemical and, depending upon the substrate, magnetic interaction. Examples of the types of particles generated and detected may include, but are not limited to: alpha particles, beta particles, gamma rays, energetic protons, deuterons, tritons, and neutrons. The particles generated by the implementations of method 10 may have various applications. For example, the generated particles may be captured by other nuclei to create new elements, may be used to remediate nuclear waste, may be used to create strategic materials, or may be used to treat cancerous tumors. As an example there are some sites that have groundwater that is contaminated with radionuclides, such as technetium, Tc-99. The particles emitted by electrochemical cell 100 may be absorbed by the radionuclide, Tc-99 via neutron capture, transmuting it to Tc-100 with a half life of 15.8 seconds to Ru-100, which is stable where the reaction is shown by $^{99}Tc_{43}(n,\gamma)^{100}Tc_{43}$ and the $^{100}Tc_{43}$ $\beta^-$ decays to $^{100}Ru_{44}$ with a half-life of 15.8 seconds.

Figure 2:
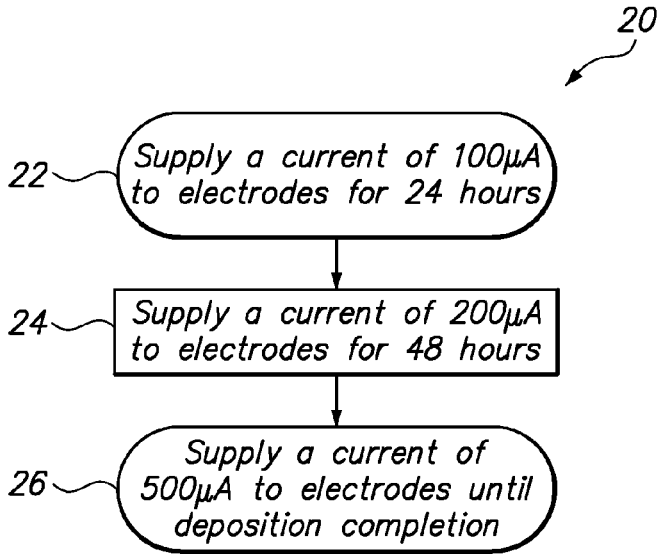
FIG. 2 illustrates a flow chart of an implementation of a first charging profile for an implementation of the method for generating particles.

FIG. 2 shows a flow chart of an implementation of step 20 of method 10. Step 20 may include more than one current level and more than one time period, wherein each of the current levels is supplied across the anode and the cathode for one of the time periods. Step 20 may be performed to assure good adherence of the palladium, a deuterium absorbing metal, to cathode 132, which may be a wire having a length of 2 cm and a diameter of 0.5 cm. Step 20 may involve low current densities for adhering the palladium to cathode 132. As an example, step 20 may begin at step 22, where a reducing current of 100 μA may be supplied to the anode and cathode for a time period of about twenty-four hours. Next, step 24 may involve supplying a reducing current of 200 μA to anode 130 and cathode 132 for a time period of about forty-eight hours. Step 20 may then proceed to step 26, where a reducing current of 500 μA may be supplied to anode 130 and cathode 132 until the completion of the deposition process. The completion of the deposition process will occur when the plating solution appears clear as described above. As an example, the amount of time required for the completion of the deposition process may be between approximately 3 and 7 days, depending upon the surface area of cathode 132 and the first charging profile used.

As current is applied, Pd is deposited on the cathode. Electrochemical reactions occurring at the cathode include:

$$Pd^{2+}+2e^{-}Pd^{0}$$

$$D_2O+e^{-}D^{0}\pm OD^{-} \quad \text{(Eq. 1)}$$

Once formed, the $D^0$ is either absorbed by the Pd or binds to another $D^0$ to form a deuterium molecule, $D_2$. At standard temperature and pressure, $D_2$ is a gas. The result is that metallic Pd is deposited on the cathode in the presence of evolving $D_2$.

Figure 3:
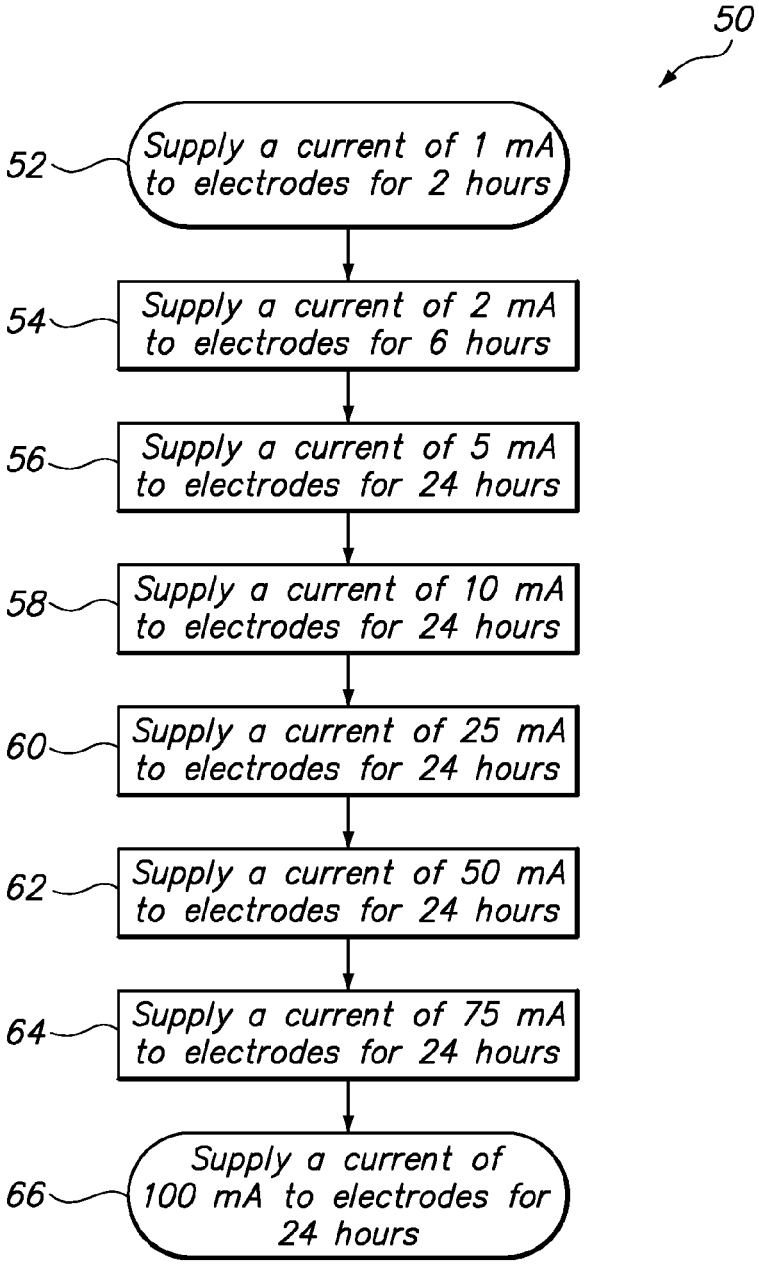
FIG. 3 illustrates a flow chart of an implementation of a second charging profile for an implementation of the method for generating particles.

FIG. 3 illustrates a flow chart of an implementation of step 50 of method 10. Step 50 may be performed to load metal 172 on cathode 132 with deuterium. In one embodiment, step 50 may involve more than one current levels and more than one time periods, wherein each of the current levels is supplied across the anode and the cathode for one of the time periods. In one embodiment, step 50 may involve levels of increasing current density to load the palladium lattice with deuterium such that the ratio of deuterium to palladium is $\geqq 1$. As an example, one implementation of step 50 may begin at step 52, where a current of 1 mA is supplied to anode 130 and cathode 132 for a time period of about two hours. Next, step 54 may involve supplying a current of 2 mA to anode 130 and cathode 132 for a time period of about six hours. Next, step 56 may involve supplying a current of 5 mA to anode 130 and cathode 132 for a time period of about twenty-four hours. Next, step 58 may involve supplying a current of 10 mA to anode 130 and cathode 132 for a time period of about twenty-four hours. Next, step 60 may involve supplying a current of 25 mA to anode 130 and cathode 132 for a time period of about twenty-four hours. Next, step 62 may involve supplying a current of 50 mA to anode 130 and cathode 132 for a time period of about twenty-four hours. Next, step 64 may involve supplying a current of 75 mA to anode 130 and cathode 132 for a time period of about twenty-four hours. Finally, step 66 may involve supplying a current of 100 mA to anode 130 and cathode 132 for a time period of about twenty-four hours.

Referring to FIGS. 4 and 5, electrochemical cell 100 may include an electrolytic solution 170, an anode 130, and a cathode 132. Electrolytic solution 170 may comprise a metallic salt having a first metal that substantially absorbs deuterium when reduced to an atomic state, and a supporting electrolyte, each dissolved in heavy water. As an example, the metallic salt may be selected from the group of transition metals, such as palladium. In one embodiment, where the deuterium atoms bind to one another to create deuterium gas, the reduced metal 172, such as palladium, absorbs deuterium 174. In another embodiment, as shown in FIG. 5, gaseous deuterium atoms collect on the surface of cathode 132 and enter into the lattice of metal 172 when in a reduced state. In one implementation, electrolytic solution 170 comprises 20-25 mL solution of 0.03 M palladium chloride and 0.3 M lithium chloride in deuterated water.

Cathode 132 may be partially immersed in electrolytic solution 170. Cathode 132 may comprise a second metal that does not substantially absorb deuterium 174 and is generally stable in electrolytic solution 170 when cathode 132 is polarized. For example, cathode 132 may be comprised of Au, Ag, Pt, as well as their alloys. In some embodiments, cathode 132 may comprise a second metal that does absorb deuterium 174 and is generally stable in electrolytic solution 170 when cathode 132 is polarized. As an example, cathode 132 may be comprised of Ni or its alloys. Cathode 132 may be formed into various shapes, such as a wire, rod, screen, or foil. In some embodiments, cathode 132 may be shaped as a wire having a diameter of 0.25 mm and a length of 2.5 cm. Anode 130 may also be partially immersed in electrolytic solution 170 and may be stable in electrolytic solution 170 when anode 130 is polarized. Anode 130 may be manufactured from any electrically conductive material which is stable in electrolytic solution 170, such as Pt, as well as their alloys. The term "stable" with reference to anode 130 and cathode 132 means that the materials employed in the construction of anode 130 and cathode 132 do not substantially corrode when they are polarized and generally do not react with the electrolyte or products of electrolysis. Anode 130 may be formed into various shapes, such as a wire, rod, screen, or foil. As an example, anode 130 may be shaped as a wire having a diameter of 0.25 mm and a length of 30 cm.

FIG. 4 illustrates a front perspective view of an embodiment of a system 100 for generating particles using an external magnetic field. System 100 may include an electrochemical cell 110, power supply 140, and magnets 160. Cell 110 may include a body portion 120 and a top portion 122. Cell 110 may be rectangular, square, cylindrical, cubical, or various other shapes as recognized in the art. Cell 110, an example of which is commercially available from Ridout Plastics, model AMAC, part number 752, may be comprised of various non-metallic materials that do not react with the electrolyte, such as butyrate. Body portion 120 may be configured to contain an electrolytic solution 170 (see FIG. 5). As an example, body portion 120 may be cubic in shape and may be comprised of a non-conductive material, such as plastic. Top portion 122 may be configured to cover body portion 120. Top portion 120 may be comprised of a non-conductive material, such as plastic. Top portion 122 may contain an opening 124 therein where an anode 130 may be passed therethrough, and also an opening 126 where a cathode 132 may be passed therethrough. Top portion 122 may also contain an opening 128 for venting purposes.

Figure 7A:
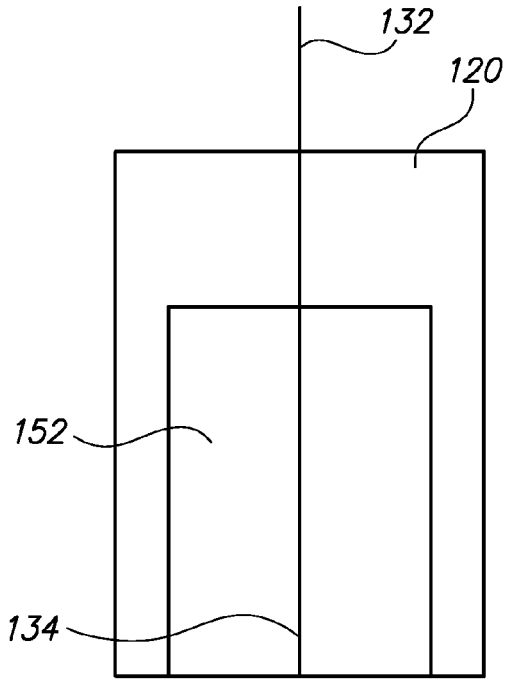
FIG. 7A illustrates a front view of one side of an embodiment of a system for generating particles using an external magnetic field, illustrating an embodiment of the cathode.
Figure 7B:
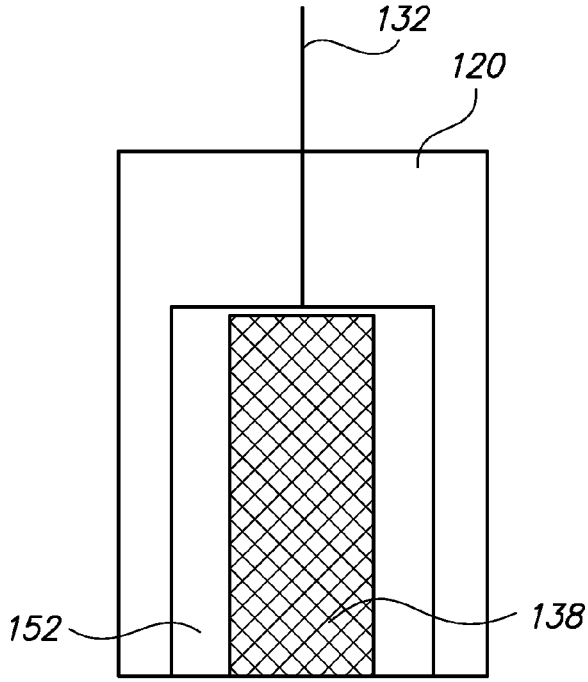
FIG. 7B illustrates a front view of one side of an embodiment of a system for generating particles using an external magnetic field, illustrating an embodiment of the cathode.
Figure 7C:
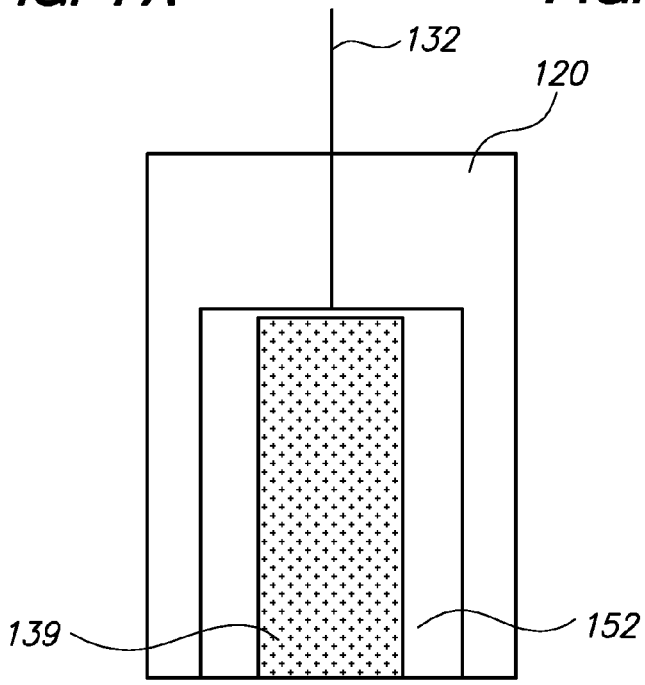
FIG. 7C illustrates a front view of one side of an embodiment of a system for generating particles using an external magnetic field, illustrating an embodiment of the cathode.

Anode 130 may comprise a wire mounted on a support 150 and may be partially immersed in electrolytic solution 170 (see FIG. 5). Support 150 may be comprised of a chemically inert material, such as polyethylene. Cathode 132 may be shaped as a single wire (as shown in FIG. 7A), a screen (as shown in FIG. 7B), or a foil (as shown in FIG. 7C). One end 131 of anode 130 may be connected to power supply 140. One end 133 of cathode 132 may be connected to power supply 140. Power supply 140 may be a potentiostat/galvanostat, an example of which is commercially available from Princeton Applied Research, model 363. The other end 135 of anode 130 may be coupled to a support 150 (see FIG. 5), which may be secured to body portion 120. Cathode 132 may be coupled to a particle detector 152 that may be attached to body portion 120. Both particle detector 152 and cathode 132 may be mounted to body portion 120. In one embodiment, particle detector 152 may be contiguous with cathode 132. In another embodiment, detector 152 may be in proximity to cathode 132, such that particles emitted from cathode 132 may contact particle detector 152. For example, particle detector 152 may be positioned adjacent to cathode 132. As another example, particle detector 152 may be positioned between cathode 132 and body portion 120. Particle detector 152 may be used to detect the occurrence of particles.

Particle detector 152 may be comprised of a non-metallic material. In one implementation, particle detector 152 may be comprised of CR-39 material. CR-39 is a thermoset resin that is chemically resistant to the electrolyte and to electromagnetic noise. CR-39 may be commercially obtained from Landauer. Particle detector 152 may comprise various shapes. As an example, particle detector 152 may be rectangular in shape with dimensions of 1 cm×2 cm×1 mm. When traversing a plastic material such as CR-39, particles create along their ionization track a region that is more sensitive to chemical etching than the rest of the material. After treatment with an etching agent, tracks remain as holes or pits that may be seen with the aid of an optical microscope. The size, depth of penetration, and shape of the tracks provides information about the mass, charge, energy, and direction of motion of particles generated by method 10. Neutral particles, like neutrons, will produce knock-ons, or charged particles resulting from the collision with the neutron that will leave ionization tracks, or, with sufficient energy (e.g. >12 MeV) cause $^{12}C$ present in the CR-39 resin to fission into 3 charged $\alpha$ particles that will leave ionization tracks.

Magnets 160 and 162 may be positioned adjacent to body portion 120 such that a magnetic field is created within electrochemical cell 100 between anode 130 and cathode 132 and though electrolytic solution 170. In some embodiments, the magnetic field created between magnets 160 and 162 may be sufficient to hold magnets 160 and 162 in position adjacent to body portion 120. In other embodiments, magnets 160 and 162 may be attached to body portion 120. Magnet 160 may be positioned adjacent to the surface of body portion 120 that contacts support 150. Magnet 162 may be positioned adjacent to the surface of body portion 120 that contacts detector 152. Magnets 160 and 162 may be comprised of various magnetic materials, such as NeFeB. As an example, the dimensions of magnets 160 and 162 may be 1 in×1 in×0.25 in. Magnets 160 and 162 may be commercially obtained from Dura Magnetics, part number NS-10010025. As an example, the external magnetic field created by magnets 160 and 162 may have a magnetic flux between about 1800 and 2200 Gauss. Magnets 160 and 162 may be permanent magnets or may be electromagnets.

FIG. 5 illustrates a cross-section view of a cell 110 during a co-deposition process. As shown, cell 110 is connected to power supply 140 and includes electrolytic solution 170 therein. Electrolytic solution 170 may comprise a soluble metallic salt (not shown) having a first metal, such as palladium, and a supporting electrolyte (not shown), wherein the palladium and chlorine are combined to form a palladium chloride complex anion, $PdCl_4^-$. The palladium chloride complex anion may be dissolved in heavy water ($D_2O$) (not shown), with the palladium absorbing deuterium 174 when in a reduced state. The supporting electrolyte may include an ionizable salt to increase solution conductivity. Examples of ionizable salts may include: alkali metal chlorides, nitrates, and perchlorates. In one embodiment, electrolytic solution 170 may be comprised of a metallic salt such as 0.05 M $PdCl_2$ and a salt such as 0.3 M LiCl dissolved in 99.9 percent pure heavy water. During the co-deposition process, metal 172 infused with deuterium 174 may be deposited on cathode 132, while oxygen 176 accumulates around anode 130.

Figure 6:
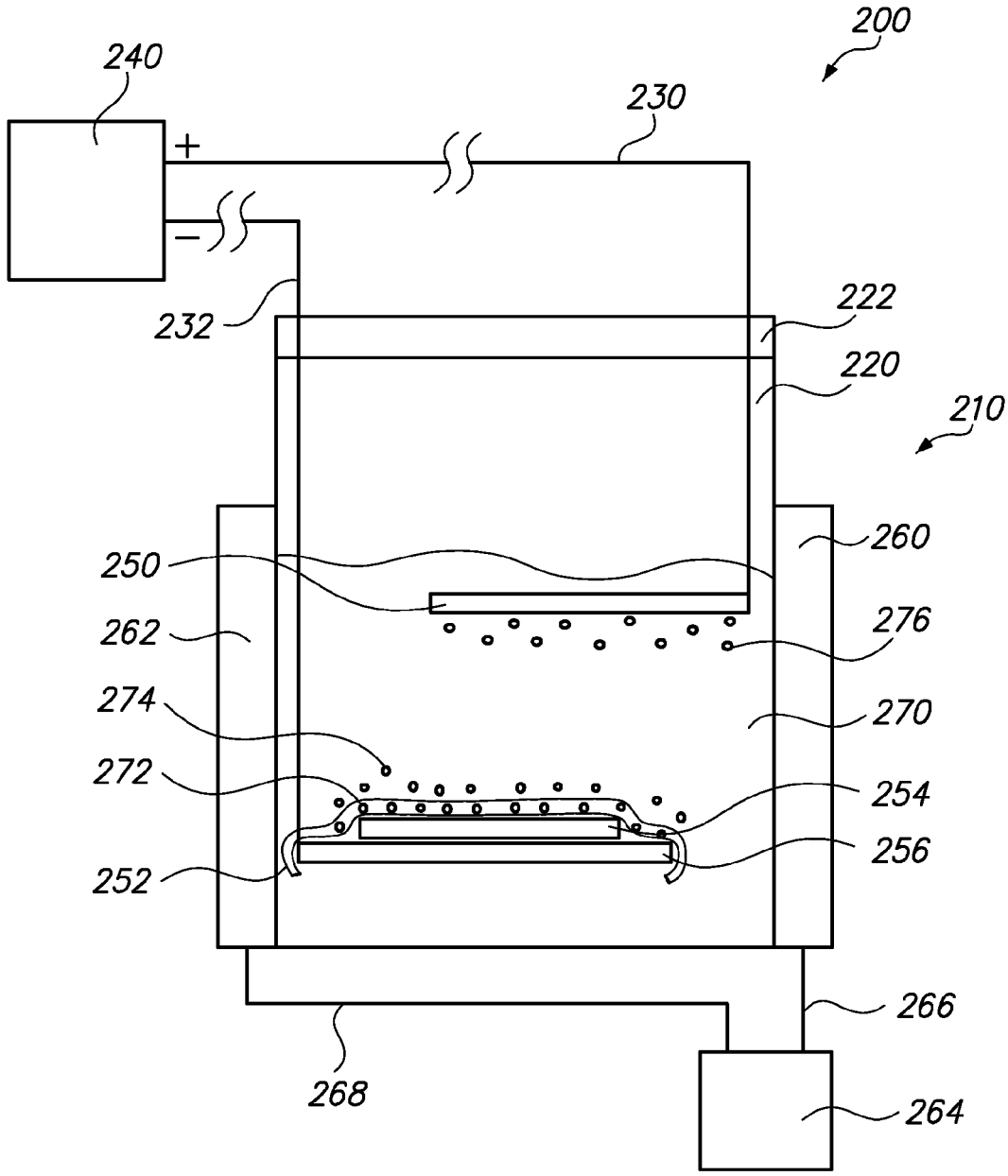
FIG. 6 illustrates a cross-section view of an embodiment of a system for generating particles using an external electric field

FIG. 6 illustrates a cross-section view of an embodiment of a system 200 for generating particles using an external electric field. System 200 may include an electrochemical cell 210, power supply 240, and external electrodes 260 and 262. Cell 210 may include a body portion 220 and a top portion 222. Top portion may contain an opening 224 (not shown) therein where an anode 230 may be passed there through, and also an opening 226 (not shown) where a cathode 232 may be passed there through. Top portion 222 may also contain an opening 228 (not shown) for venting purposes. Cell 210 may be rectangular, square, cylindrical, or various other shapes as recognized in the art. Cell 210 may be comprised of various non-metallic materials, such as butyrate. Anode 230 and cathode 232 may be connected to power supply 240. Power supply 240 may be a potentiostat or a galvanostat. Anode 230 is attached to a support 250. Cathode 232 may be coupled to a particle detector 254 that is attached to a support 256. Particle detector 254 may be comprised of a non-conductive material. In one implementation, particle detector 254 is comprised of CR-39 material.

Electrodes 260 and 262 may be positioned adjacent to body portion 220 such that an electric field may be created between anode 230 and cathode 232. In some embodiments, electrodes 260 and 262 may be secured to body portion 220 by an adhesive. Electrodes 260 and 262 are positioned adjacent to the surface of body portion 220 perpendicular to anode 230 and cathode 232. Electrodes 260 and 262 may be comprised of various conductive materials as recognized by one with ordinary skill in the art, such as copper. As an example, electrodes 260 and 262 may be less than one inch in diameter. Electrode 260 may be connected to a regulated high voltage source 264 via wire 266, whereas electrode 262 may be connected to regulated high voltage source 264 via wire 268. Wires 266 and 268 may comprise any suitable electrical wire as recognized by one with ordinary skill in the art. An example of a voltage source 264 that may be utilized with system 200 is voltage source model 4330, which may be commercially obtained from EMCO. Voltage source 264 may be used to apply 6000V DC (with about 6% AC component) across electrodes 260 and 262.

Electrochemical cell 210 includes an electrolytic solution 270. Electrolytic solution 270 may comprise a metallic salt having a first metal that substantially absorbs deuterium when in a reduced state (not shown), and a supporting electrolyte (not shown), each dissolved in heavy water (not shown). As an example, the metallic salt may be selected from the group of transition metals, such as palladium. In one embodiment, where the deuterium atoms bind to one another to create deuterium gas, the reduced deuterium absorbing metal 272, such as palladium, absorbs deuterium 274. In another embodiment, deuterium atoms collect on the surface of cathode 232 and enter into the lattice of deuterium absorbing metal 272 when in a reduced state. In one implementation, electrolytic solution 270 comprises 20-25 mL solution of 0.03 M palladium chloride and 0.3 M lithium chloride in deuterated water.

Referring to FIGS. 7A-7C, FIG. 7A shows a front view of one side of an embodiment of system 100, illustrating an embodiment of the cathode 132. As shown, cathode 132 is attached to detector 152. In this implementation, cathode 132 consists of a wire 134. As an example of a commercially available wire 134, may be obtained from Aldrich, Au wire part number 326534 or Pt wire part number 349402. The cathode may be 0.25 mm in diameter, and be 3 cm in length. FIG. 7B illustrates a front view of one side of an embodiment of system 100, illustrating another embodiment of cathode 132. As shown, cathode 132 is attached to detector 152. In this implementation, cathode 132 is formed as a screen 138. Screen 138 may serve to increase the surface area for particle emission. Screen 138 may be comprised of various metallic materials, such as Ni, Cu, Ag, and Au. As an example, a screen 138 commercially available from Delker, part number 3 Ni 5-077, is comprised of nickel, is 3 cm in size, has a thickness of 0.08 mm, and has eyelet dimensions of 1.5 mm×2.0 mm. FIG. 7C illustrates a front view of one side of an embodiment of system 100, illustrating another embodiment of cathode 132. As shown, cathode 132 is attached to detector 152. In this implementation, cathode 132 is formed as a foil 139. Foil 139 may serve to increase the surface area for particle emission. Foil 139 may be comprised of various metallic materials, such as Ni, Cu, Ag, and Au. As an example, a foil 139 commercially available from Aldrich, part number 349267, is 2.5 cm in size and has a thickness of 0.025 mm.

In the absence of an external electric/magnetic field, Scanning Electron Microscope (SEM) analysis of electrodes prepared by Pd/D co-deposition exhibit highly expanded surfaces consisting of small spherical nodules to form a cauliflower-like morphology. Cyclic voltammetry and galvanostatic pulsing experiments indicate that, by using the co-deposition technique, a high degree of deuterium loading (with an atomic ratio D/Pd>1) is obtained within seconds. These experiments also indicate the existence of a $D_2^+$ species within the Pd lattice. Because an ever expanding electrode surface is created, non-steady state conditions are assured, the cell geometry is simplified because there is no longer a need for a uniform current distribution on the cathode, and long charging times to achieve high deuterium loadings are eliminated.

Using the Pd/D co-deposition process, radiation emission and tritium production were documented. The results indicated that the reactions were nuclear in origin and that they occurred in the subsurface. To enhance these surface effects, experiments were conducted in the presence of either an external electric or magnetic field. SEM analysis showed that when a polarized Au/Pd/D electrode was exposed to an external electric field, significant morphological changes were observed. These changes ranged from re-orientation and/or separation of weakly connected globules, through forms exhibiting molten-like features. EDX analysis of these features showed the presence of additional elements (in an electric field Al, Mg, Ca, Si, and Zn; in a magnetic field Fe, Cr, Ni, and Zn) that could not be extracted from cell components and deposited on discrete sites.

To verify that the new elements observed on the cathodes were nuclear in origin, the Pd/D co-deposition was done in the presence of a CR-39 detector. CR-39 is a polyallydiglycol carbonate polymer that is widely used as a solid state nuclear track dosimeter chip. When traversing a plastic material such as CR-39, charged particles create along their ionization track a region that is more sensitive to chemical etching than the rest of the bulk. After treatment with an etching agent, tracks remain as holes or pits and their size and shape can be measured.

It should be noted that, in the area of modern dosimetry, CR-39 dosimeter chips are the most efficient detectors for the detection of light particles (alphas or protons). Experiments were conducted in which either a Ni screen or Au/Ag/Pt wire was wrapped around a CR-39 chip and was then used as the substrate for the Pd/D co-deposition. After the Pd was completely plated out, the cell was exposed to either an external electric or magnetic field. The experiment was terminated after two days and the CR-39 chip was etched using standard protocols (6.5 N NaOH at 70° C. for 6-7 hrs). After etching, the chip was examined under a microscope.

Figure 8A:
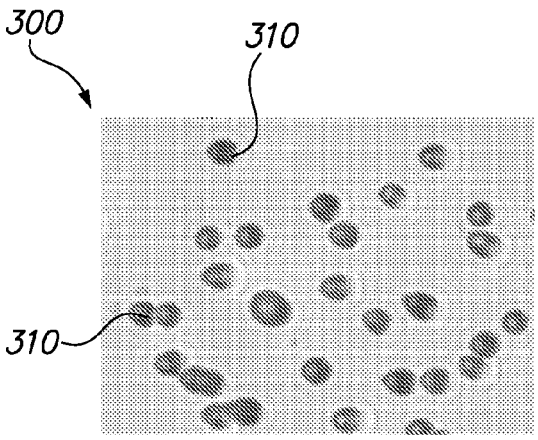
FIGS. 8A and 8B show images of alpha particle tracks in a CR-39 detector, where the microscope optics are focused on the surface of the detector and the bottom of the pits, respectively.
Figure 8C:
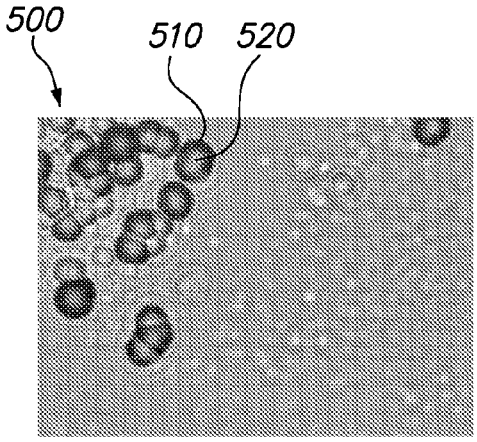
FIGS. 8C and 8D show images of Pd/D co-deposition generated tracks in a CR-39 detector, where the microscope optics are focused on the surface of the detector and the bottom of the pits, respectively.
Figure 8B:
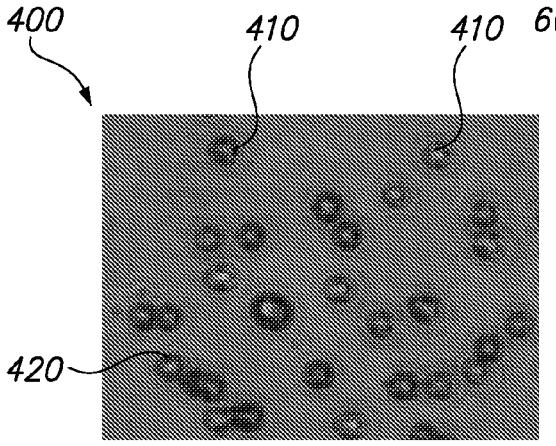

The Pd/D co-deposition generated pits in CR-39 have the same properties as those created by nuclear particles as shown in FIGS. 8A and 8B. FIGS. 8A and 8B are microphotographs 300 and 400, respectively, of tracks in CR-39 due to an alpha source. When the microscope optics are focused on the surface of the detector, as shown in FIG. 8A, it can be seen that the tracks 310 are symmetrical in shape and dark in color. When the microscope optics are focused inside the pits 410, as shown in FIG. 8B, bright spots 420 are observed. Tracks have a conical shape. The bright spot 420 is caused by the bottom of the track acting like a lens when the detector is backlit. The dark, symmetrical shapes with bright spots at their centers are diagnostic of nuclear generated tracks.

Figure 8D:
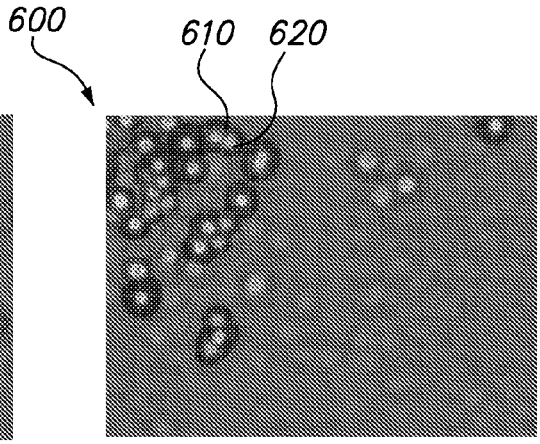

FIGS. 8C and 8D show microphotographs 500 and 600, respectively, of Pd/D co-deposition generated tracks 510 and 610 obtained by focusing the microscope optics on the surface and the bottom of the pits, respectively. It can be seen that the Pd/D co-deposition generated tracks are dark and symmetrical in shape, with bright spots 520 and 620, respectively, inside them.

Figures 9A, 9B:
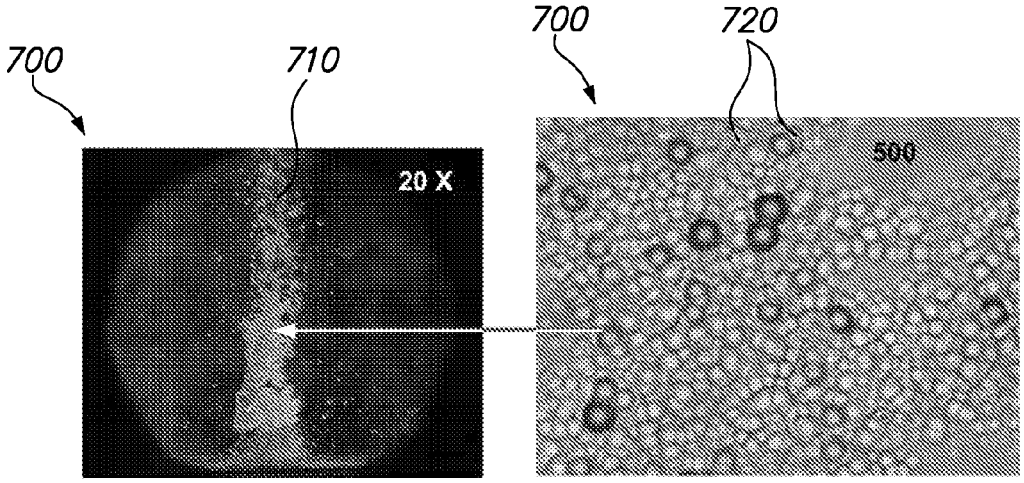
FIGS. 9A and 9B show images taken of the CR-39 detector after a Pd/D co-deposition experiment in a magnetic field.

FIGS. 9A and 9B show images taken of the CR-39 detector after a Pd/D co-deposition experiment in a magnetic field. FIG. 9A illustrates a magnified image 700 of a CR-39 taken after a Pd/D co-deposition experiment in a magnetic field in accordance with an embodiment of the system and method for generating particles. FIG. 9B illustrates a further magnified image of image 700.

The electrode substrate used to create these images is a 0.25 mm diameter Ag wire. Visible inspection of the CR-39 chip showed a cloudy area where the electrode substrate was in close proximity to the CR-39 detector. The cloudy area 710 shown in FIG. 9A is approximately 0.5 mm wide and 4.6 mm long. The fact that the cloudy area was only observed where the detector was in close proximity to the cathode indicates that the cathode has caused the cloudiness. The 500× magnification of the center of the cloudy area shown in FIG. 9B illustrates the presence of numerous overlapping tracks 720, both large and small. The number of tracks is far more than are observed in laser fusion experiments (typically DD or DT).

Figures 10A, 10B:
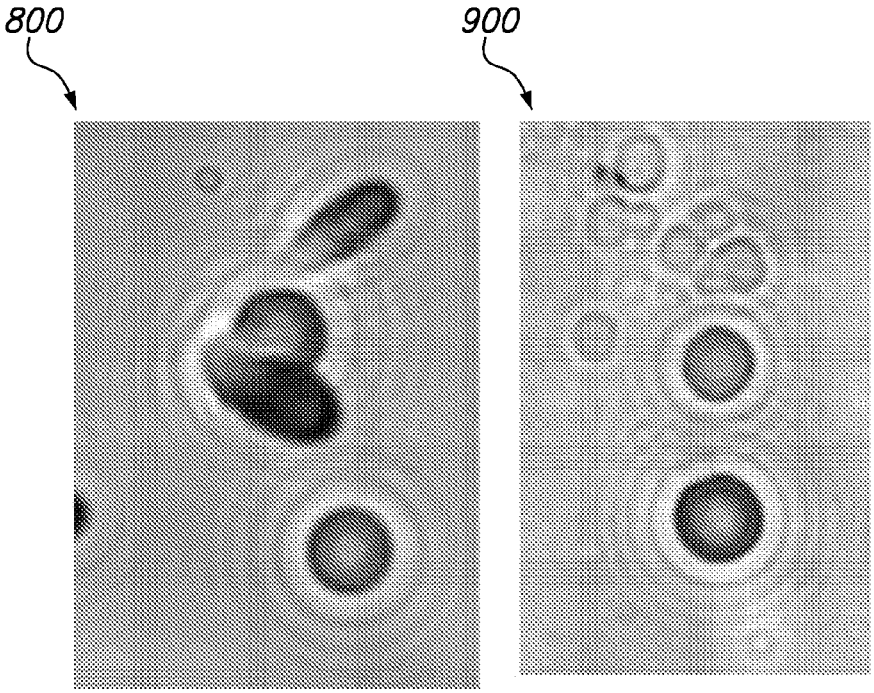
FIG. 10A shows features observed when a CR-39 detector is exposed to depleted Uranium.
FIG. 10B shows features observed when a CR-39 detector has undergone exposure to a Pd/D co-deposition experiment in the presence of an external electric field.

FIGS. 10A and 10B show a side-by-side comparison of features observed when the detector is exposed to depleted U and a detector that has undergone exposure to a Pd/D co-deposition experiment in the presence of an external electric field. FIG. 10A illustrates a magnified image 800 of a CR-39 detector exposed to depleted uranium. FIG. 10B illustrates a magnified image 900 of a CR-39 detector exposed to a Pd/D co-deposition experiment performed on a Au wire in the presence of a 6000V external electric field in accordance with the disclosed subject matter. Since the features look the same, and since depleted Uranium is giving off alphas, it stands to reason that the features observed for the co-deposition experiment are also due to high energy particles. These particles can be either alphas, protons, or neutrons.

Figure 11:
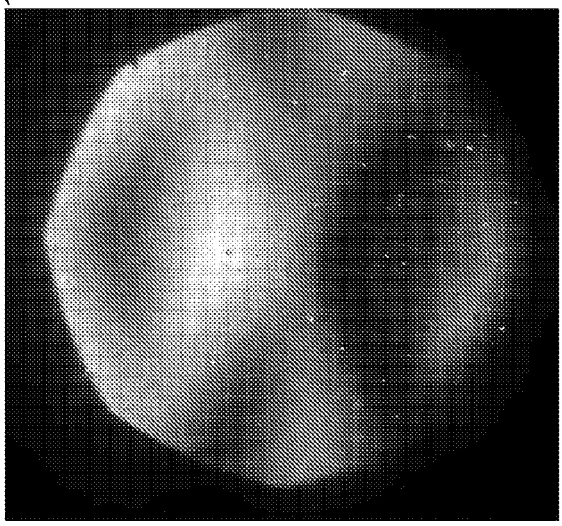
FIG. 11 illustrates an image of a CR-39 detector indicating X-ray emission, in accordance with an embodiment of the system and method for generating particles.

It should be noted that in the absence of an external electric/magnetic field, when Ni screen is used as the cathode, no tracks are observed on the CR-39 chip, as shown in FIG. 11. FIG. 11 illustrates an image 1000 of a CR-39 detector indicating X-ray emission, in accordance with an embodiment of the system and method for generating particles. Instead of tracks, the impression of the electrode substrate is observed in the CR-39 detector which has been caused by the emission of soft X-rays from the cathode.

Figure 12A:
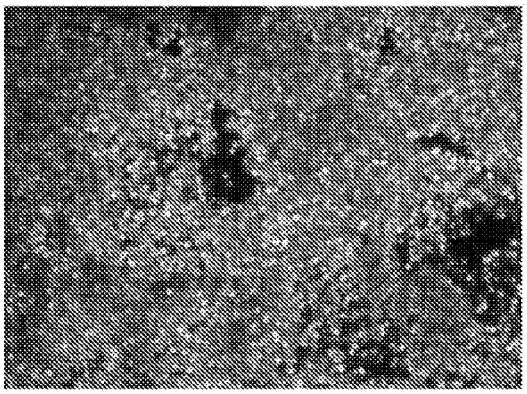
FIG. 12A shows an image taken of a CR-39 detector after a Pd/D co-deposition experiment on a Ni screen cathode in the presence of a magnetic field.
Figure 12B:
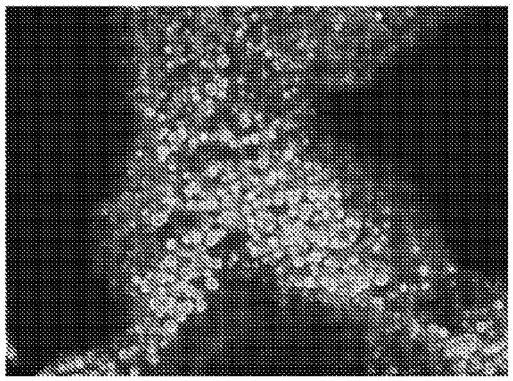
FIG. 12B shows an image of a CR-39 detector after a Pd/D co-deposition experiment on a Ni/Au composite cathode in which Au is a high Z material.

The size of the tracks is proportional to the energy of the particle that created the track. It has been observed that the energy of the particles created in these experiments can be controlled by the electrode substrate. When the Pd/D co-deposition reaction is done on a light Z material such as Ni, the particles are small and homogeneous in size, as shown in image 1100 shown in FIG. 12A. However, when the reaction is done on a higher Z material, such as Ag, Au, or Pt, both large and small particles are observed, as shown in FIGS. 9A, 9B, 10B, 12A, and image 1200 shown in FIG. 12B.

Figure 13A:
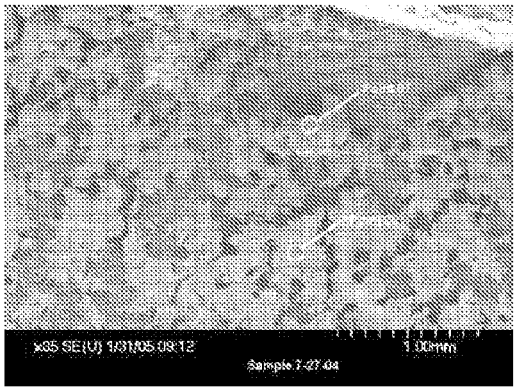
FIG. 13A shows an SEM of the Pd deposit obtained on a Au foil cathode in a magnetic field experiment.
Figure 13B:
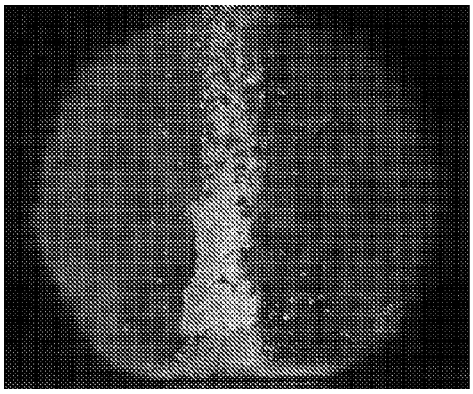
FIGS. 13B-13D show images taken of a CR-39 detector after a Pd/D co-deposition experiment in a magnetic field using a Ag wire cathode.
Figure 13C:
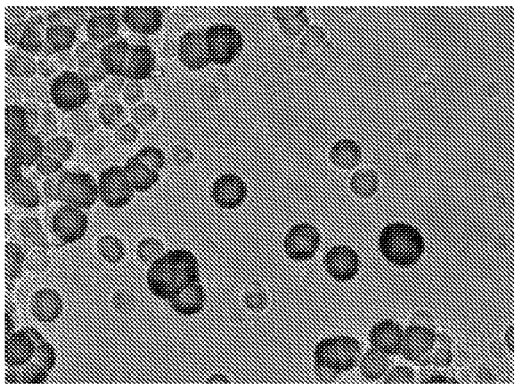
Figure 13D:
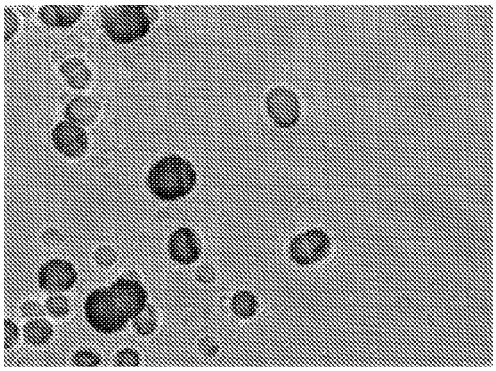

FIG. 13A shows an SEM image 1300 of the Pd deposit on Au foil that has been exposed to a magnetic field. The Lorentz lines of the magnetic field have caused the Pd micro-globules to form star-like features. FIGS. 13B-13D show images 1400, 1500, and 1600, respectively, taken of a CR-39 detector after a Pd/D co-deposition experiment in a magnetic field using a Ag wire cathode. FIG. 13B shows that the tracks coincide with the Pd deposit indicating that the Pd deposit is the source of the tracks. FIGS. 13C and 13D show magnified images of the tracks. The tracks vary in size indicating that particles of different types and energies are being produced.

Specific Example

Materials

Palladium chloride (99%, Aldrich), lithium chloride (analytical grade, Mallinckrodt), deuterated water (99.9% D, Aldrich), 0.25 mm diameter gold wire (99.9%, Aldrich), 0.5 mm diameter silver wire (99.9% Aldrich), 0.25 mm diameter platinum wire (99.9%, Aldrich), nickel screen (Delker, 0.35 mm thick and eyelet dimensions of 3 mm×1.9 mm).

Cell Design

Cell design as shown in FIGS. 4-6.

Charging Procedure

Typically 20-25 mL solution of 0.03 M palladium chloride and 0.3 M lithium chloride in deuterated water is added to the cell. Palladium is then plated out onto the cathode substrate using a charging profile of 100 μA for 24 h, followed by 200 μA for 48 h followed by 500 μA until the palladium has been plated out. This charging profile assures good adherence of the palladium on the electrode substrate. Once the palladium has been plated out of solution, the external electric or magnetic fields are applied. In the external electric field configuration as shown in FIG. 6, copper electrodes (~1 inch in diameter) are taped to the outside of the cell wall. A regulated high voltage source (EMCO model 4330) is used to apply 6000 V DC (and has a ~6% AC component) across these copper electrodes. In the magnetic field configuration as shown in FIGS. 4 and 5, the attractive forces between the 1 in×1 in×0.25 in permanent NdFeB magnets (available from Dura Magnetics) hold them in place on either side of the cell, as shown in FIGS. 4 and 5. The strength of the magnetic field is on the order of 2000 Gauss. After the palladium has been electrochemically plated out and the external field has been applied, the cathodic current is increased to 1 mA for 2 h, 2 mA for 6 h, 5 mA for 24 h, 10 mA for 24 h, 25 mA for 24 h, 50 mA for 24 h, 75 mA for 24 h, and 100 mA for 24 h.

Summary of Results

With a Ni screen cathode and no external field, there is X-ray emission (see FIG. 11). There are charged particles seen (alphas and protons) when an external electric or magnetic field is applied. For cathodes made of higher Z materials (Ag, Au, Pt), charged particles are obtained in the absence of an external field. Tracks are observed on the back of the CR-39 which is indicative of neutron generation. The neutrons produced can have various energy levels. Besides the emission of alphas, protons, soft X-rays, and neutrons, the cells also produce tritium, gammas, and betas.

A summary of some necessary conditions to obtain pits are contained in Table 1 shown below. The column labeled "Experiment" indicates the type of cathode used, while the "Field" column indicates whether an electric or magnetic field was used. Unless otherwise indicated, Pd/D co-deposition was performed using LiCl and $D_2O$.

TABLE 1

| Experiment | Field | Result |
|---|---|---|
| Ni screen | None | No pits, see impression of Ni screen |
| Ni screen | E or B | Pits in patches |
| Ag wire | None, E, or B | High density of pits |
| Au or Pt wire | E or B | High density of pits |
| Ag, KCI | E or B | High density of pits |
| Ag, $H_2O$ | E or B | Pits, less dense than $D_2O$ |
| Pd wire, no co-dep | E or B | Pits in patches |
| $CuCl_2$ in place of $PdCl_2$ | None, E, or B | No pits |

Additionally, Table 2 shown below represents a summary of experiments performed to determine if the CR-39 pits were due to contamination or electrolysis.

TABLE 2

| Experiment | Result |
|---|---|
| Place $PdCl_2$ powder on surface of CR-39 | No pits |
| Immerse CR-39 in $PdCl_2$—LiCl—$D_2O$ | No pits |
| Wrap cathode substrates around CR-39 | No pits |
| Electrolysis using Ni screen and LiCl—$D_2O$ | No pits |

Many modifications and variations of the system and method for generating particles are possible in light of the above description. Therefore, within the scope of the appended claims, the system and method for generating particles may be practiced otherwise than as specifically described. Further, the scope of the claims is not limited to the embodiments and implementations disclosed herein, but extends to other embodiments and implementations as may be contemplated by those with ordinary skill in the art.

We claim:

1. A method comprising the steps of:

supplying more than one current levels, each current level not exceeding about 500 μA, to the anode and the cathode of an electrochemical cell according to a first charging profile, wherein the electrochemical cell comprises:

a body portion, an electrolytic solution, contained within the body portion, comprising a metallic salt, comprising palladium, and a supporting electrolyte, each dissolved in heavy water, a cathode immersed in the electrolytic solution and vertically disposed adjacent to a first side of the body portion, the cathode comprising a metal that does not substantially absorb deuterium and is stable in the electrolytic solution when the cathode is polarized, and an anode immersed in the electrolytic solution apart from the cathode and vertically disposed adjacent to a second side of the body portion, the second side located opposite the first side, wherein the anode is stable in the electrolytic solution when the anode is polarized; and maintaining each of the supplied more than one current levels at a generally constant level during the first charging profile such that deposition of palladium on the cathode occurs in the presence of evolving deuterium gas during electrolysis of the electrolytic solution.

2. The method of claim 1, wherein the metal is selected from the group of metals consisting of nickel, gold, silver, and platinum, and their alloys.

3. The method of claim 1, wherein the cathode is formed as a foil.

4. The method of claim 1, wherein the step of supplying more than one current levels, each current level not exceeding about 500 μA, to the anode and the cathode of an electrochemical cell according to a first charging profile includes the steps of supplying a current of about 100 μA to the anode and the cathode for a time period of about twenty-four hours, supplying a current of about 200 μA to the anode and the cathode for a time period of about forty-eight hours and supplying a current of about 500 μA to the anode and the cathode until deposition of metallic ions on the cathode terminates.

5. The method of claim 1, wherein the metal comprises nickel and the cathode is formed as a screen.

6. The method of claim 5 further comprising the steps of:

exposing the electrochemical cell to an external magnetic field after the termination of the deposition of the palladium on the cathode; and supplying current to the anode and the cathode according to a second charging profile during the exposure of the electrochemical cell to the external magnetic field.

7. The method of claim 6, wherein the step of supplying current to the anode and the cathode according to a second charging profile includes the steps of:

supplying a current of about 1 mA to the anode and the cathode for a time period of about two hours;

supplying a current of about 2 mA to the anode and the cathode for a time period of about six hours;

supplying a current of about 5 mA to the anode and the cathode for a time period of about twenty-four hours;

supplying a current of about 10 mA to the anode and the cathode for a time period of about twenty-four hours;

supplying a current of about 25 mA to the anode and the cathode for a time period of about twenty-four hours;

supplying a current of about 50 mA to the anode and the cathode for a time period of about twenty-four hours;

supplying a current of about 75 mA to the anode and the cathode for a time period of about twenty-four hours; and supplying a current of about 100 mA to the anode and the cathode for a time period of about twenty-four hours.

* * * * *